United States Patent [19]

Crowther

[11] 4,053,374

[45] Oct. 11, 1977

[54] CHROMIUM ELECTROPLATING BATHS

[75] Inventor: John C. Crowther, Stourbridge, England

[73] Assignee: Albright & Wilson Limited, Warley, England

[21] Appl. No.: 717,765

[22] Filed: Aug. 25, 1976

[30] Foreign Application Priority Data

Aug. 27, 1975 United Kingdom ..... 35337/75

[51] Int. Cl.[2] ..... C25D 3/06

[52] U.S. Cl. ..... 204/51

[58] Field of Search ..... 204/51, 105 R, 43 R

[56] References Cited

U.S. PATENT DOCUMENTS

| | | | |
|---|---|---|---|
| 3,006,823 | 10/1961 | Deyrup | 204/51 |
| 3,706,639 | 12/1972 | Bride et al. | 204/51 |
| 3,733,346 | 5/1973 | Bride | 204/51 X |
| 3,733,347 | 5/1973 | Bride | 204/51 X |
| 3,788,957 | 1/1974 | Christie et al. | 204/51 |
| 3,833,485 | 9/1974 | Crowther et al. | 204/43 R |
| 3,954,574 | 5/1976 | Gyllenspetz et al. | 204/51 X |

FOREIGN PATENT DOCUMENTS

| | | | |
|---|---|---|---|
| 668,751 | 11/1929 | France | 204/51 |

*Primary Examiner*—G. L. Kaplan

*Attorney, Agent, or Firm*—Flynn & Frishauf

[57] ABSTRACT

In trivalent chromium electroplating baths of the type which comprise an aqueous solution of a complex of trivalent chromium with a carboxylic acid such as a glycolic acid and a halide such as a chloride, the invention provides an improvement by adding ammonia to the baths in a proportion of at least 0.05 moles per liter, thereby obtaining substantially improved covering power.

5 Claims, No Drawings

CHROMIUM ELECTROPLATING BATHS

The present invention relates to chromium electroplating baths wherein the chromium is present as trivalent chromium. A number of such baths have been described from time to time, but generally they have failed to achieve any commercially acceptable performance. In particular inadequate covering power and/or throwing power has been a characteristic of most of the chromium electroplating baths whose compositions have been published to date.

Recently, a type of bath composition has been proposed in a series of U.S. Pats. which includes U.S. Pat. No. 3,729,392, U.S. Pat. No. 3,706,638 and U.S. Pat. No. 3,706,639. These specifications describe baths which contain trivalent chromium as a preformed complex comprising a carboxylic acid and a halide.

We have now discovered that the aforesaid type of compostion gives substantially improved performance in the presence of ammonia. Our invention therefore provides an aqueous trivalent chromium electroplating bath comprising a water soluble complex of trivalent chromium with a di- or poly- carboxylic or hydroxy carboxylic acid having from 2 to 10 carbon atoms and a halide, in an amount sufficient to provide from 0.5 to 3 moles per liter of trivalent chromium and from 0.05 moles per liter to saturation of ammonium ion.

The chromium is preferably present in the solution as a preformed complex substantially as described in the aforesaid specifications.

The carboxylic acid constituent has from 2 to 6 carbon atoms and may include for example a di- or polycarboxylic or hydroxy carboxylic acid such as oxalate, lactate, citrate or tartarate. However, the preferred carboxylic acid for the purposes of the present invention is glycolic acid. The carboxylic acid is normally present in a molar ratio to chromium of from 0.7 : 1 to 3 : 1.

The halide constituent may comprise fluoride, chloride or bromide. Iodide is unsuitable at least for use as the sole halogen, due to a tendency for free iodine to precipitate and fumes to be evolved at the anode, although the presence of traces of iodide is not excluded. Bromide may be employed in accordance with the present invention, but generally the preferred halogen in complexes of this type is chloride. Mixtures of halides, e.g. mixtures of bromide and chloride may be employed. The halogen is usually present in a molar ratio to chromium of from 0.1 : 1 to 3.5 : 1, preferably in the case of chloride or bromide, 0.4 : 1 to 1 : 1. Customarily where fluoride is employed the preferred ratio is higher, e.g. from 2.6 : 1 to 3.2 : 1. The complex may be prepared by any of the methods described in detail in any of the aforesaid U.S. Patents.

The ammonium is an essential constituent of the baths and is preferably present in a proportion of at least 0.1 molar and preferably not more than 5 molar, e.g. from 0.2 to 4 molar, preferably 0.5 to 3 molar, especially, 0.7 to 2.5 molar.

The effect of the ammonium is to increase, substantially, the covering power of the bath and the quality of the deposit, giving a clean bright deposit over a wide current density range and with good throwing power. The ammonium is preferably added to the bath in the form of ammonium chloride or sulphate.

In order to obtain satisfactory commercial results it is customery to include borate in baths of this type. The borate is preferably present in a proportion of at least 0.1 molar, e.g. 0.5 to 1 molar. Higher proportions, while not generally harmful, are economically undesirable.

The baths normally contain a proportion of conductivity salts. These are generally alkali metal or alkaline earth salts of strong mineral acids e.g. salts such as sodium or potassium chloride or sulphate, which have a high dissociation constant. The amount is not critical and may range between zero and saturation, but is preferably about 1 to 5 molar, e.g. 2 to 4 molar.

The pH of the baths is acid, usually between 1.8 to 4.9.

The baths may contain wetting agents, antifoams and similar surface active compositions which are customarily present in electroplating baths, in the effective amounts normally employed.

Apart from the foregoing species, it is generally unnecessary and often undesirable to include othe additives in the solutions of our invention. For example, sulphite which has been recommended in the aforesaid U.S. Patent is preferably absent from solutions of our invention. Generally speaking we have found that proportions of sulphite greater than about 0.01 molar adversely affect the brightness of the deposit.

Polar aprotic solvents such as dimethyl formamide have been widely recommended for addition to trivalent chromium plating baths. However, we prefer to omit such solvents from our baths because they tend to lower the conductivity of the solution, to be expensive, and to be associated with serious effluent problems.

In other respects the preparation, maintenance and operation of the baths of the present invention are generally substantially the same as for the baths described in the aforesaid U.S. Patent Specifications, except for the increased current density range which may be used due to the improved covering power.

Typically the baths are used at temperatures of between ambient and 60° C preferably 20° C to 50° C, e.g. 30° C to 40° C.

The bright deposits have been obtained over a current density range of between 50 to 1,000 ASF, using the baths of the present invention. In contrast, severe restrictions of the upper end of the current density range have been admitted in respect of the prior art baths. Our experiments indicate that in the baths of the published prior art, a bright result cannot be obtained at current densities substantially outside a very narrow range of 30 - 350 ASF.

Additives have been proposed in the prior art for extending this range but have generally been either ineffective or unacceptable in commercial practice on grounds of cost or effluent problem.

The invention is illustrated by the following Examples:

EXAMPLE

A volume of 50% weight/weight chromic chloride solution equivalent to 260 g chromium was taken and 1,308 g of 66% glycollic acid was added. To this was added 487 g potassium hydroxide in water (equivalent to 1,083 g 45% weight/weight potassium hydroxide). The hydroxide was added with stirring. The solution was made up to 3.3 liters giving a concentration of 78 g chromium per liter.

A plating solution was prepared from the complex described above as follows: 2 liters of the complex solution were diluted to 3.3 liters and heated to 140° F. Additions of 520 g potassium chloride and 252 g boric acid were made and the solution held at 140° F for 30 minutes. 45 mls of bis(2 methoxyethyl) ether was added and the bath electrolysed for 6 ampere hours per liter using a carbon anode and nickel plated brass cathode. The pH was adjusted to 2.8 with potassium hydroxide.

The solution contained 39 g per liter chromium.

Nickel plated brass Hull Cell panels were plated at 10 amperes for 3 minutes from the plating solution as a comparative standard (run no. 1) in a Hull Cell fitted with circulatory cooling and graphite anode. The tests were then repeated with various additions.

In order to test the effect on the solution of adding ammonium, a series of runs (no's 2, 3 and 4) were carried out adding 5.5, 11 and 33 g per liter of ammonium chloride respectively. The results are set out in the following table:

TABLE

| | ADDITION | TEMP ° C | pH | BRIGHT PLATING RANGE ASF | THICKNESS IN/U IN. 400 | 200 | 100 | 50 | 20 ASF |
|---|---|---|---|---|---|---|---|---|---|
| 1. | None | 25 | 2.8 | 350–30 (dull above 350) | 58 | 44 | 32 | 6 | — |
| 2. | 5.5 gpl $NH_4Cl$ (0.1M $NH_4$) | 25 | 3.0 | 1,000–50 (very clean) | 33 | 24 | 21 | 4 | — |
| 3. | 11 gpl $NH_4Cl$ (0.2M $NH_4$) | 25 | 3.0 | 1,000–50 (very clean) | 28 | 21 | 25 | 8 | — |
| 4. | 33 gpl $NH_4Cl$ (0.6N) | 25 | 3.0 | 1,000–50 (very clean) | 18 | 15 | 18 | 3 | — |

We claim:

1. An aqueous chromium electroplating bath having a pH between 1.8 and 4.9 consisting essentially of water, from 0.05 moles to saturation of ammonia and a water soluble complex of trivalent chromium with (A) glycolic acid, and (B) 0.1 to 3.5 moles of a halide per mole of chromium, said chromium being present in an amount sufficient to provide 0.5 to 3 moles per liter of trivalent chromium.

2. A bath as claimed in claim 1 wherein there is additionally present at least 0.1 moles of borate.

3. A bath as claimed in claim 2 wherein the halide is selected from fluoride and chloride.

4. A bath as claimed in claim 3 additionally containing salts selected from the sulphates, chlorides and fluorides of sodium and potassium.

5. An aqueous chromium electroplating bath having a pH of from 1.8 to 4.9 and consisting essentially of water, from 0.2 to 4 molar ammonium, from 1 to 5 molar of at least one salt selected from the chlorides and sulphates of sodium and potassium and a complex of trivalent chromium with (A) from 0.7 to 3 moles of glycolic acid per mole of chromium and (B) from 0.1 to 1 mole of chloride per mole of trivalent chromium.

* * * * *